US007205498B2

(12) United States Patent
Gresko et al.

(10) Patent No.: US 7,205,498 B2
(45) Date of Patent: Apr. 17, 2007

(54) CLOSURE LINING AND COLOR DETECTOR

(75) Inventors: Gerald M. Gresko, Greensberg, PA (US); Daniel L. Brant, Uniontown, PA (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/773,641

(22) Filed: Feb. 6, 2004

(65) Prior Publication Data

US 2004/0159588 A1 Aug. 19, 2004

Related U.S. Application Data

(62) Division of application No. 10/041,374, filed on Jan. 8, 2002, now Pat. No. 6,689,978, which is a division of application No. 09/479,140, filed on Jan. 7, 2000, now Pat. No. 6,376,006.

(51) Int. Cl.
*B07C 5/342* (2006.01)
*B07C 5/00* (2006.01)

(52) U.S. Cl. ..... 209/580; 209/524; 209/528; 209/577; 209/928

(58) Field of Classification Search ..... 209/580, 209/928, 552, 576, 577, 587, 588, 523, 524, 209/529, 528
See application file for complete search history.

(56) References Cited

U.S. PATENT DOCUMENTS 3,633,781 A * 1/1972 Zapata ..... 215/328
3,746,163 A 7/1973 Ochs et al. ..... 209/73
4,136,781 A 1/1979 Perry et al. ..... 209/552
4,644,341 A 2/1987 Warner ..... 340/753

(Continued)

OTHER PUBLICATIONS

Sensick CS 1 by SICK optic electronic, Colour Sensor Operating Instructions, date unknown.
EN2 High-Speed Sensor Logic Controller and Power Supply/ EN3 Dual Voltage Power Supply by Sick optic electronic pp. 1 through 11, date unknown.
"Luminescence Sensors" luminescence pp. 364 through 369, date unknown.
Smarteye Fiber Optic registration Marks Scanner/Series CMS, *Tri-Tronic*, 8 pages.

*Primary Examiner*—Patrick Mackey
*Assistant Examiner*—Mark Hageman
(74) *Attorney, Agent, or Firm*—Woodcock Washburn LLP

(57) ABSTRACT

A system is disclosed for detecting or inspecting for a lining of a container closure that is formed of a sheet metal and has a panel on an inside surface of the closure. The panel of the closure has a lining formed thereon. The system according to the present invention includes a conveyor for moving plural closures longitudinally and substantially through the system, a color sensor that inspects the panel of each one of the closures on the conveyor for a predetermined color, and a separator that is capable of removing closures that lack the predetermined color. The system may include an oven downstream from the sensor to bake the lining. Thus, the system automatically identifies and removes the closure having the deficient color from the conveyor. A corresponding method for identifying and removing a closure having a deficient color is also disclosed.

9 Claims, 4 Drawing Sheets

U.S. PATENT DOCUMENTS

| | | | | |
|---|---|---|---|---|
| 4,668,983 | A * | 5/1987 | Werson | 348/134 |
| 4,938,371 | A | 7/1990 | Vercillo | 215/352 |
| 5,190,177 | A | 3/1993 | Collins | 215/252 |
| 5,215,587 | A | 6/1993 | McConnellogue et al. | 118/699 |
| 5,322,566 | A | 6/1994 | Satoh et al. | 118/712 |
| 5,441,994 | A | 8/1995 | Moriga et al. | 523/201 |
| 5,731,053 | A | 3/1998 | Kuhn et al. | 428/369.2 |
| 5,805,279 | A * | 9/1998 | Palombo et al. | 356/239.4 |
| 6,010,740 | A | 1/2000 | Rutledge et al. | 427/8 |
| 6,175,644 | B1 | 1/2001 | Scola et al. | 382/141 |
| 6,384,421 | B1 * | 5/2002 | Gochar, Jr. | 250/559.46 |
| 6,784,447 | B2 * | 8/2004 | Gochar, Jr. | 250/559.46 |

* cited by examiner

CLOSURE LINING AND COLOR DETECTOR

This is a divisional of U.S. patent application Ser. No. 10/041,374 filed Jan. 8, 2002 now U.S. Pat. No. 6,689,978, which is a divisional of U.S. patent application Ser. No. 09/479,140 filed Jan. 7, 2000, which issued as U.S. Pat. No. 6,376,006.

BACKGROUND OF THE INVENTION

This invention relates to detecting and separating objects and more particularly to a system and method for detecting or sensing the adequacy of a lining or color on a work piece in a high speed industrial process and removing work pieces that have an inadequate lining or color.

Metal closures for plastic and glass containers are well-known and popular for packaging food and other products. A conventional metal closure for a packaging container often is a screw closure of the kind having a peripheral skirt with an internal lining of a compound. Either after forming or upon assembly of the closure to the neck of a container, the closure internal lining is capable of permanently or semi-permanently conforming to screw thread formations on the container neck or to the container neck or rim. Thus, the lining may form or enhance sealing between the closure and the container such that the container may contain a negative pressure or vacuum therein, which is typically formed during the product filling process. As an example of a lining in this regard, a plastisol compound may be sprayed onto the inside surface of the closure panel, after which the closure having the plastisol may be heat cured before coupling the closure to the container. The lining preferably is substantially deformable such that the lining forms or enhances sealing between the closure and the container neck and/or rim.

A particular type of closure that is suitable for a container having an internal vacuum may be first fitted on the container by the beverage or food manufacturer by a simple pressing and/or twisting action. The closure subsequently may be repeatably removed by the consumer using a conventional twisting action. Such closures are often referred to as "press-twist" closures. Press twist and other vacuum closures are often used for products that are either hot-filled or are thermally pasteurized or sterilized after filling and closing, such as baby food products, preserves, and the like.

Press twist closures often are provided with tamper-evident buttons at the center of their closure panels, which overlie the mouth of the container to which they are fitted. A typical button is an integral, raised circular part of the closure panel, which is held in an inverted, depressed position by the vacuum within the container, but which returns resiliently to its raised position if the vacuum is for any reason subsequently broken or substantially reduced. The button thus indicates, for example, whether the integrity of the seal between the container and the closure has been maintained, or the closure has not made a proper seal with the container. A button disposed in its raised position before an initial opening by an end user may indicate that the product contents of the container may be degraded or spoiled.

Other closures are of the "roll-on" type, which describes the manner in which the skirt is formed with screw threads after the closure has been applied to the container. Roll-on closures are used extensively for liquid products such as fruit cordials and squashes, spirits and mineral waters, which are typically filled cold, and normally do not require heat treating after filling and closing. Roll-on type closures also form a seal between the closure and the container in order to enhance preservation and freshness of the contents of the container, and to maintain an internal negative pressure or vacuum within the container until the initial opening of the closure by an end user.

The closure lining process typically is a high-speed, automated process in which an uncured plastisol or similar compound is sprayed onto an inside surface of a panel of the closure. Typical through-puts on a belt conveyor or other conventional conveyor may be, for example, 300 to 800 closures per minute, although rates of 2500 closures per minute or more may also be achieved. Inherent in such a high-speed lining coating or spray process, some of the closures produced by such a process will have a lining that is discontinuous or missing, or otherwise falling outside of specified values or tolerances. For example, one of a series of spray nozzles may become clogged, the supply of compound material may become interrupted such that spray is interrupted, a closure may be misaligned with a spray nozzle, or like spraying failures may cause one or a series of closures to be moved from a compound station even though it lacks an appropriate lining.

The problem of a deficient or missing lining is exacerbated because a closure having a deficient or missing lining may produce a disproportionately large economic impact in that the deficient or missing lining is often detected only after filling of a product in the container. Specifically, after a container has been filled with product, a pressure or tamper-evident button on the closure may indicate that the seal between the closure and the container is not air tight. In circumstances in which a deficient closure panel lining is the cause of the insufficient seal, the failure of the seal may cause the entire container and contents to be discarded. Conventional inspection methods generally have been insufficient to fully alleviate this problem.

SUMMARY OF THE INVENTION

An automated and accurate system according to an aspect of the present invention is provided for identifying and removing closures having a deficient lining from a conveyor line, thereby eliminating the problematic closures from the line. The system detects or inspects for a lining of a container closure that is formed of a sheet metal and has a panel on an inside surface of the closure. The panel of the closure has a lining formed thereon. The system according to the present invention includes a conveyor for moving plural closures longitudinally and substantially through the system, a color sensor that inspects a panel of each one of the closures on the conveyor for a predetermined color, and a separator that is capable of removing closures that lack the predetermined color. Thus, the system automatically identifies and removes the closures that have the deficient color from the conveyor.

The conveyor may have a conveying surface that supports an outside surface of said closures such that the closures to be inspected have their panel area, on which the lining should be present, facing the color sensor (that is, the panel area is generally facing up). Thus, the conveyor moves the closures from the compound station, through the sensor area at which the panel color is assessed, and to or through the separator region of the system. The color sensor is capable of identifying a sufficient color status that corresponds to a sufficient lining and a deficient color status that corresponds to an insufficient lining. In this regard, the color sensor preferably detects the absence of a suitable lining on the closure by sensing or detecting a predetermined color that corresponds to a substantially bare metal panel. The separator is capable of removing closures having a deficient color status from said conveyor.

The sensor may be calibrated to sense only the color of the bare metal of the interior surface of the closure panel such that the sensor recognizes the bare metal as a deficient color status. Preferably, the sensor includes a RBG system that senses reflected light from the lining on the closure panel. Preferably, the sensor is disposed between the compound station and an oven for curing the lining. Thus, upon recognizing a deficient color status (that is, a color that corresponds to a deficient or missing lining), the sensor may send a signal to a controller. The controller may, after a suitable time delay, send a signal to the separator such that the separator may remove the closure having the deficient color status from the conveyor. Preferably, the separator includes an air jet to blow the closure having a deficient color status from the conveyor.

According to another aspect of the present invention, a method is provided for identifying container closures having a deficient color status from container closures having a sufficient color status. The method includes the steps of: (a) forming a compound on an inside panel surface on substantially each one of the closures in a compound station; (b) conveying the closures from said compound station to a color sensor on a conveyor; (c) sensing a color of each one of the closures by said color sensor; (d) identifying said color as either a sufficient color or a deficient color such that the sufficient color status corresponds to a predetermined amount of compound at a predetermined portion of the panel of each of the closures; and (e) automatically separating the closures having a deficient color status from the closures having a sufficient color status. The method according to the present invention may also include a heating or a curing step that preferably is subsequent to the identifying step.

According to another aspect of the present invention, a system is provided for detecting a predetermined color of decorated metal disks that are capable of being formed into container closures. The system includes a conveyor for moving plural decorated metal disks longitudinally therealong, a color sensor that senses a colored side of each one of said decorated metal disks for a predetermined color, and a separator capable of removing from said conveyor a decorated metal disk having a deficient color status. The decorated metal disks have the colored side oriented upwardly or the conveyor. The color sensor is capable of identifying a sufficient color status that corresponds to a predetermined color on at least a portion of said decorated metal disk and a deficient color status that corresponds to a color that is not said predetermined color.

The separator preferably is an air jet that blows off or removes the deficient decorated metal disk from the conveyor in response to a controller's signal. The controller receives an appropriate signal from the color sensor and optionally from another sensor (which will indicate when a disk is present). Thus, the system automatically identifies and removes the decorated metal closures that have said deficient color from the conveyor. Further, the system may include a lithographic or other printing station and a shearing station for forming the decorated metal disks from a metal sheet. The system may also include a feed press station for forming the disks into closures. Preferably, the color sensor is disposed between the printing and shearing station, and the feed press station.

According to another aspect of the present invention, a method is provided for identifying a predetermined color of decorated metal disks that are capable of being formed into container closures. The method comprises the steps of (a) conveying the decorated metal disks to a color sensor on a conveyor; (b) sensing a color of each one of the decorated metal disks by said color sensor; (c) identifying the color as either a sufficient color or a deficient color, the sufficient corresponding to a predetermined color, the deficient color corresponding to color that is not the predetermined color; and (d) automatically separating the decorated metal disks having a deficient color status from the closures having a sufficient color status.

The method also may include the step of printing at least one color onto substantially each one of the decorated metal disks in a printing station. The printing encompasses, for example, lithographically printing the at least one color onto substantially each one of the decorated metal disks. Preferably, the predetermined color corresponds to a desired color for the decorated metal disk, whereby the desired color is determined according to the trade dress or desired decoration of a product for which the decorated metal disk is intended.

DESCRIPTION OF A PREFERRED EMBODIMENT

Figure 1:
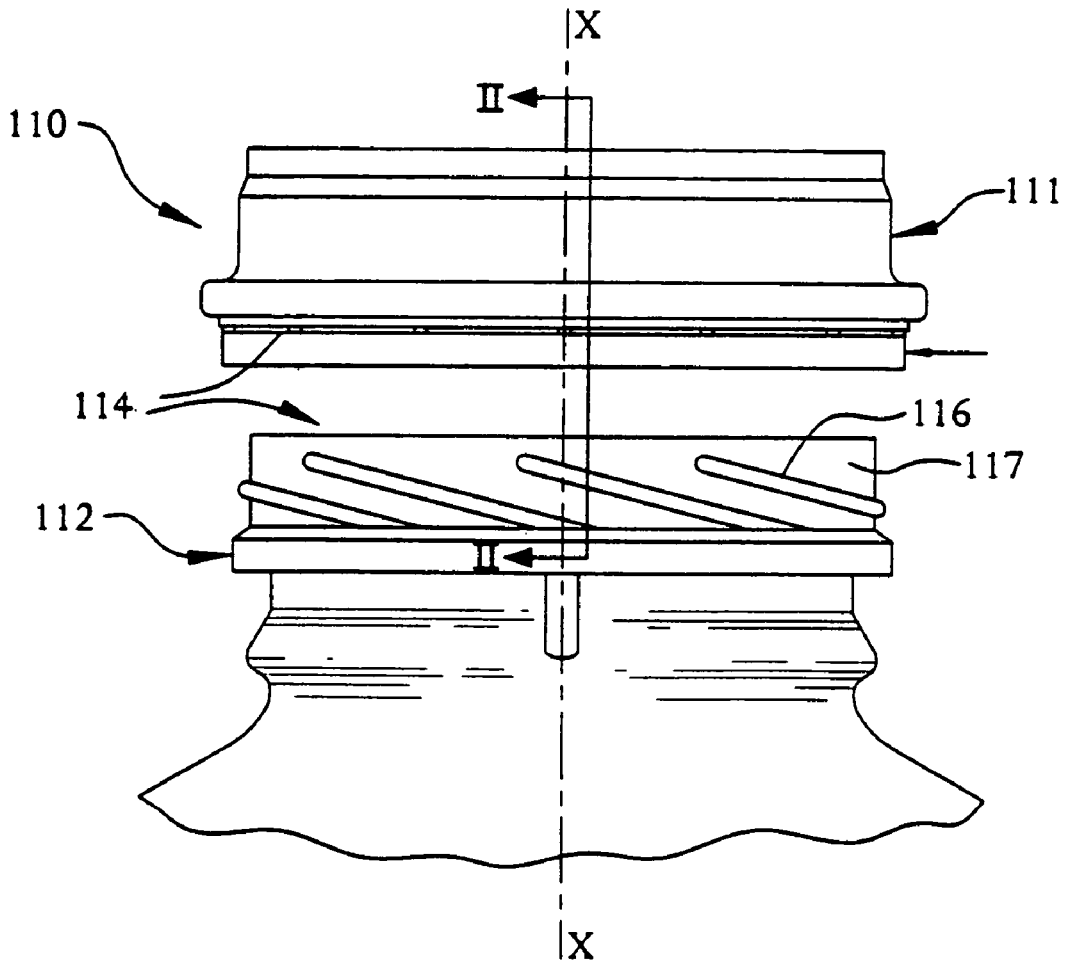
FIG. 1 ( PRIOR ART )
FIG. 1 (PRIOR ART) is an exploded side view of a conventional closure and a container to which the closure may be fitted.
Figure 2:
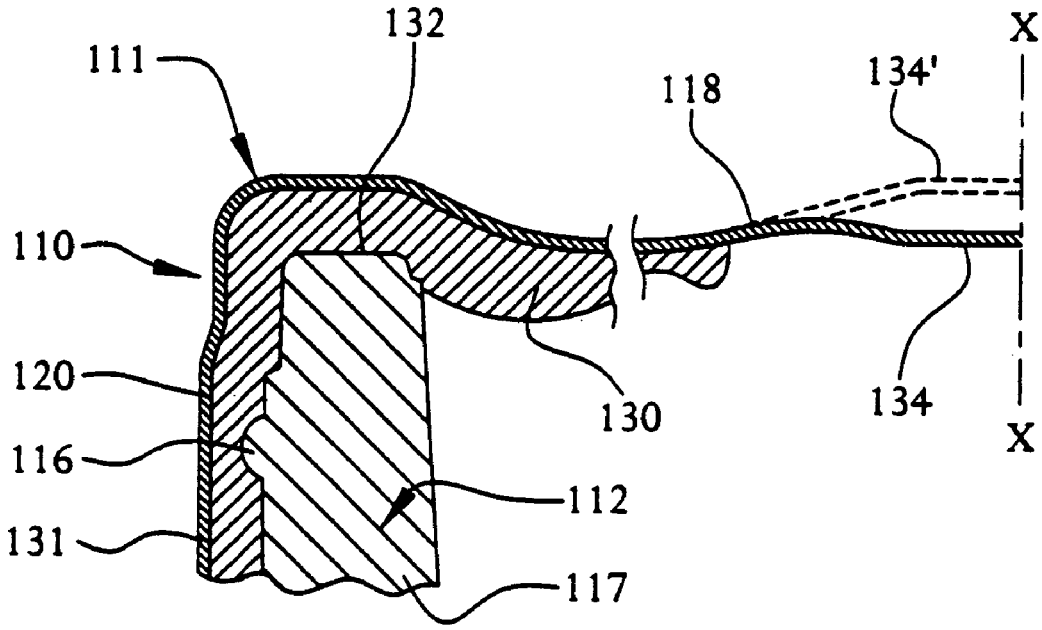
FIG. 2 ( PRIOR ART )
FIG. 2 (PRIOR ART) is an enlarged sectional view taken on the line II—II of FIG. 1.

Referring to FIGS. 1 and 2 to illustrate a conventional metal closure with which the system and method of the present invention may be employed, a closure 110 is shown in relation to the generally cylindrical neck 112 of a glass container, which is generally of the type for packaging a food product such as baby food. A common central axis of the container and of the closure is indicated by the line X—X. The neck 112 defines a container mouth 114. A multi-start screw thread 116 is formed on an exterior surface of container neck 112. Preferably, screw thread 116 is formed on a substantially cylindrical portion 117 of the container neck 112. Thus, the closure 110 may be engaged with screw thread 116 for removal or replacement of closure 110 by the user by conventional twisting of closure 110 relative to container neck 112.

Closure 110 has a metal body 111 which is conventionally formed by pressure upon a suitable sheet material. A generally planar closure panel 118 is formed in the body 111 such that panel 118 overlies the container mouth 114. A tubular skirt 120 is peripherally formed with the closure panel and depends downwardly therefrom to form a conventional cap-like shape. A portion of the interior of closure body 111 has a lining 130 of a conventional plastisol compound. As shown in FIG. 2, the plastisol lining 130 is disposed on the panel 118 and extends across the top free edge 132 of the container neck 112. Further, the lining may extend into an interior portion of the skirt 120 such that is contacts thread 116. Alternatively, a lining (not shown) may be formed only on a top or annular portion of the closure so as to form a seal between the closure and the top free edge 132 such that the lining does not extend into the skirt area.

The lining 130 may be formed on the interior portion of closure 110 by any conventional means. The lining may be one that requires heat curing before coupling to a container (that is, requiring heat curing after the lining is applied but before the closure is assembled onto the container) or heat curing after the closure is assembled onto the container. Further, the lining may be of the type that requires no heat curing. For example of heat curing after assembly, the lining may have a cylindrical bore which is an interference fit with the screw thread 116 of the container. Thus, the closure 110 may fitted onto the container by the food packer by simple axial movement, and during subsequent thermal processing of the container the lining may take a set by which it is made permanently to conform to the container screw thread for subsequent twist-off removal or replacement of the closure by the user. Alternatively, for example, the lining may be heat cured before coupling the container to the closure. Thus, the closure may be assembled to the container such that the lining forms or enhances the seal between the closure and the container without further heat curing after assembly. The composition of the lining compound will be determined according to the particular, desired characteristics of the lining usage and heat treatment method, as will be understood by persons familiar with container closure technology and corresponding lining compositions and technology.

Closure 110 typically has a circular button 134 formed in its closure panel 118 and arranged to indicate whether a vacuum of the required level exists in the headspace of the container. In FIG. 2, the button is represented by solid lines to illustrate its inverted or depressed position, which corresponds to the existence of a negative pressure (that is, relative to ambient pressure) or vacuum within the container. Button 134' is represented by broken lines to illustrate a relaxed or raised position, which corresponds to the lack of a negative pressure or vacuum with the container. U.S. Pat. No. 5,190,177, entitled, "Metal Screw Closures for Packaging Containers," more fully describes such a, closure, and is incorporated herein by reference in its entirety.

As described in U.S. Pat. No. 5,441,994, entitled "Plastisol Composition" and incorporated herein by reference in its entirety, liners of plastisol and similar composition are well-known for hermetically sealing container closures. Characteristics that may be important in determining the composition of a lining for a particular application include fluidity, the lack of particular volatile components such as solvents, and the capability for the compound to gel upon heating to form a predetermined or desired shape, and that they have a suitable degree of softness and cushioning property. Further, U.S. Pat. No. 5,731,053, entitled "Potable Liquid Container" and which is also incorporated herein by reference in its entirety, describes an in-shell technique for forming gaskets or liners.

Figure 3:
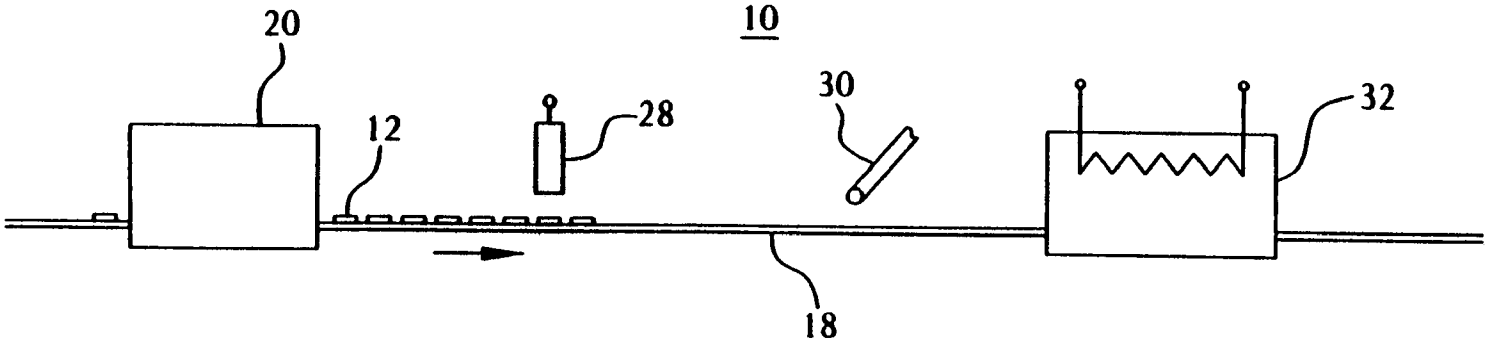
FIG. 3 is schematic view of a lining production and detection system according to an aspect of the present invention.
Figure 5:
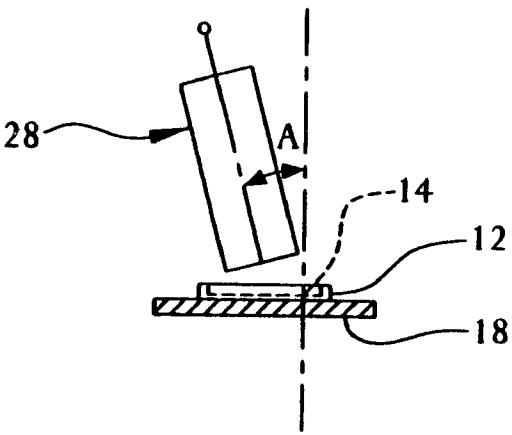
FIG. 5 is a view of another portion of the system of FIG. 3.
Figure 4:
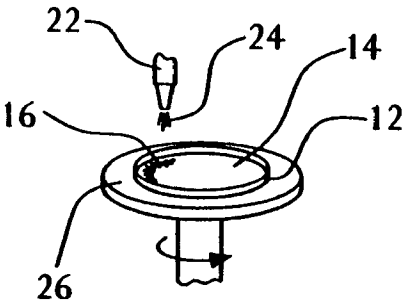
FIG. 4 is a schematic view of a portion of the system of FIG. 3.

Referring to FIGS. 3 through 5 to illustrate an embodiment of the present invention, a closure lining and detection system 10 is provided that automatically and rapidly senses or detects the sufficiency or presence of a lining disposed on the underside of a container lid or closure 12. The lining and sensing system 10 may include a conveyor 18, a compound machine 20, a sensing apparatus, such as color sensor 28, a separator 30, and an oven 32.

Conveyor 18 preferably is a high speed conveyor that moves and manipulates plural closures 12 throughout the system 10. Conveyor 18 may be a single conveyor or several conveyor sub-systems that work together to move and manipulate the closures. For example, a conventional belt conveyor may be employed up to oven 32 (that is, on the inlet side of the oven). The closures may be automatically transferred from the conventional belt conveyor to a second conveyor, which is rated for high temperature duty, to move the closures through oven 32. Further, a conventional third conveyor may receive the closures at the outlet of oven 32 to move them to subsequent stations for further processing, inspection, or packaging. Also, as described more fully below, the conveyor 18 may encompass devices to manipulate the closures during the lining process, including for example, multiple or parallel turntable devices.

As shown schematically in FIG. 4, compound station or compound machine 20 may include a spray nozzle 22 that sprays a layer of plastisol on an inside panel surface of closure 12. Preferably, multiple nozzles are employed in the compound station to substantially simultaneously spray multiple closures. Preferably, one nozzle 22 is oriented to spray onto a portion of the interior of the closure panel 14 such that the center of the spray is spaced apart from a center of the closure 12 in order to provide a lining in a predetermined position on the closure and in a predetermined shape.

Thus, the closure 12 may be disposed on a turntable 26 such that rotation of the closure 12 relative to the nozzle 22 produces a desired spray pattern of the plastisol on the panel 14 according to the desired position and thickness of the lining 16, as will be understood by persons familiar with closure technology and plastisol and similar linings. Further, the term "lining" as used herein includes any compound that has the characteristics suitable for forming or enhancing a seal between a closure and a container neck, and includes liquid or granular compounds that may be sprayed, flowed, or otherwise dispensed or metered onto a closure. The term "lining" also encompasses solid materials employed to form or enhance a seal between a closure and a container, such as a pre-formed gasket.

A sensor or detector, such as color sensor 28, according to an aspect of the present invention may be disposed between the compound machine 20 and the oven 32 as shown in FIG. 3. Alternatively, color sensor may be disposed in the inside of the compound machine (not shown), on the outlet side of the oven (that is, at the oven outlet or spaced apart from the oven outlet downstream) (not shown), or other suitable location. Preferably, color sensor 28 is a self-contained, optic-electronic sensor for optical non-contact detection of color objects in impinging light. Sensor 28 may be a RBG programmable color recognition sensor that compares color values to one or more reference colors, such as model SENSICK CS 1 supplied by SICK Inc.

Preferably, the self-contained sensor 28 is disposed over conveyor 18 at an angle A, which is shown in FIG. 5, of between 10 degrees and 30 degrees. The precise angle A may vary according to the particular characteristics of the equipment and target to be detected, including variables such as the amount and nature of ambient light, color and reflectivity of the lining and panel, and the like. The terms "senses" and "sensing" and the like refer herein to the receiving of a color on the sensitive portion of the color sensor 28. The terms are not limited to the color that satisfies the predetermined color for which the color sensor 28 is calibrated. Rather, the terms encompass light of any color or wavelength that reaches an element of the color sensor that receives the light reflected or transmitted from the appropriate portion of the closure.

The procedure for setting up sensor 28 may be as follows. A bare closure 12 (that is, a closure that lacks a lining such that its panel is bare metal) may be positioned under the sensor such that the sensor beam is visible in the channel within which the compound is to be sprayed. The sensor may be substantially aligned at the center of the closure in the direction of the conveyor movement. However, such a configuration or alignment may be determined according to the particular geometry and characteristics of the sensor and closure. If the conveyor has side rails, the closure should be disposed near the rail that is closest to the sensor 28. The sensor may then be calibrated to the color of the bare panel. For the SENSICK CS 1, the color selector switch may be appropriately positioned and its teach button suppressed until the sensor provides an appropriate indication that the color is received by the sensor device. Thus, the sensor 28 is calibrated such that it sends a signal to a controller upon sensing or detecting the predetermined color that corresponds to the bare metal color of the closure panel 14 (that is, upon sensing or detecting a closure that lacks a lining or one that has a lining that is deficient or discontinuous) within the tolerance of the sensor 28.

Upon coating with a lining of uncured plastisol or like compound, the visible color of the panel 14 portion that has the lining thereon may have a white tint and may be substantially opaque. As the closure having the compound coating passes beneath sensor 28, sensor 28 does not detect the predetermined color that corresponds to bare metal of panel 14. Therefore, the coated closure passes beneath the sensing device with no signal being sent from sensor 28. In this regard, sensor 28 detects a sufficient color status of panel 14 that corresponds to an appropriate lining. However, as a closure having a deficient, missing, or discontinuous lining passes beneath the sensor 28, the sensor 28 senses or detects the predetermined color that corresponds to the panel bare metal. Therefore, sensor 28 outputs a signal to a controller (not shown) that indicates that a closure having a defective or deficient lining (or having a lining that is in an incorrect location on the panel) has been detected. In this regard, sensor 28 senses or detects a deficient color status of the closure panel 14.

Upon detection of a defective or deficient color status by sensor 28 and upon sensor 28 outputting such a signal, the controller receives the signal. According to predetermined logic, the controller after an appropriate time interval may activate a separator 30 to remove the defective or deficient closure from conveyor 18. Separator 30 preferably includes a compressed air jet system that imparts a short burst of compressed air in the direction of the closures. Such a separator and time delay controls will be understood by persons familiar with such controls and air separating equipment and technology. A compressed air jet valve is normally fully closed, and opens only in response to a signal from the controller. In response to the signal from the controller, a separator air jet valve opens to release an air burst, which strikes the closure having the insufficient lining to blow such closure from conveyor 18.

The controller may monitor the actual conveyor speed to accurately control the delay interval corresponding to the travel time between the sensor 28 and the separator 30 along conveyor 18, or the delay interval may be fixed in circumstances in which the travel time is consistent and repeatably predictable. The time delay, which is important for properly sequencing and timing the equipment (especially the separator jet), may be determined according to the time interval between a particular closure passing the color sensor and the closure passing into the separator region. Such a time interval should be precisely controlled and accurately determined because of the high throughput of the system 10, which may be up to 2500 closures per minute, and preferably 300 to 800 closures per minute.

Oven 32 is preferably disposed on the downstream side of (that is, with respect to the ordinary direction of the conveyor) the separator. Oven 32 heats the closure to bake or cure the plastisol or other compound. Preferably, the plastisol is heated to a temperature of 380 degrees to 400 degrees Fahrenheit, although the temperature to which the closure is subjected may depend on the precise characteristics of the lining compound and the desired characteristics of the cured material. The present invention encompasses employing the color sensor subsequent (that is, downstream along the conveyor travel) to the oven 32. Because such heat treating may, in some circumstances, change the color of the plastisol from a milky white to a light tan, in the alternative configuration in which the color sensor is downstream of the oven, the color sensor should be calibrated to repeatably and consistently sense or detect the lining color even after the lining may have changed color upon curing or baking.

Figure 6:
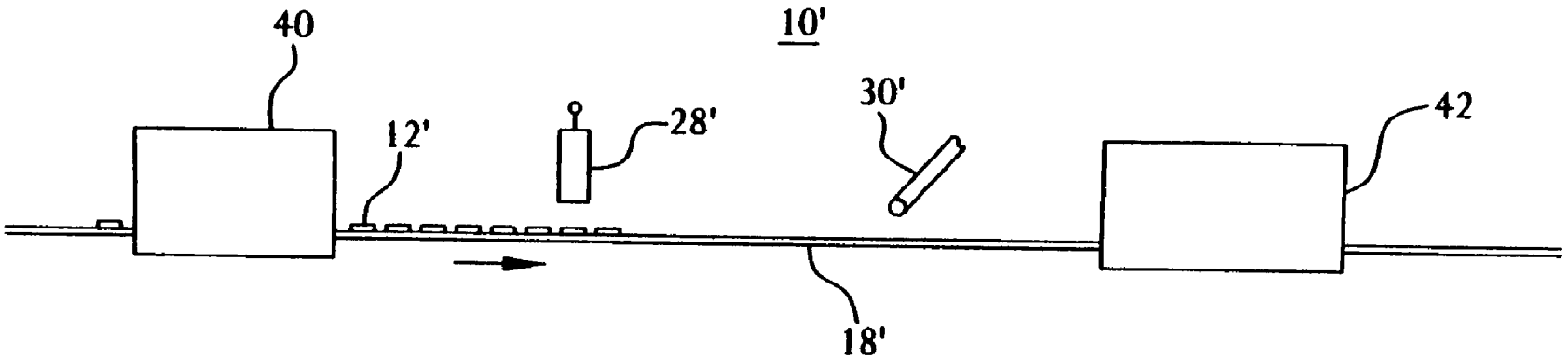
FIG. 6 is a schematic view of a printing process inspection system for decorated metal disks, according to another aspect of the present invention.

Referring to FIG. 6 to illustrate another aspect of the present invention, a process inspection system 10' is provided for sensing or detecting a color of a decorated metal disk 12' after color lithography or other printing. The decorated metal disk 12' is of the type that is subsequently formed into a metal closure 12 that is described above. System 10' includes a conveyor 18', a lithography station 40, a sensing apparatus, such as color sensor 28', a separator 30', and a feed press 42. Lithography and shearing station 40 may be any conventional printing process that is suitable for printing colors on metal for forming the decorated metal disks, and may include a subsequent conventional shearing process that shears the decorated metal into disks. For example, the printing process may be by a lithographic process and the shearing station could employ a shearing mandrel for shearing the sheet metal into disks.

Conveyor 18' is similar to conveyor 18 described above, although any conventional conveyor may be employed that moves the items through system 10'. Specifically, a bare metal sheet (not shown) suitable for receiving lithographic printing thereon is moved into the lithography station 40, in which the metal sheet is printed thereon and sheared into the decorated metal disks 12'. Preferably, the metal sheet receives the printing via a conventional lithography process, although the present invention encompasses employing any conventional printing process suitable for printing decorated metal disks of the type that may be formed into closures.

The printing process may also employ registration marks printed or debossed onto the metal sheet. The registration marks may be used by the shearing process and the feed press 42 to register the work piece during the respective operations, as will be understood by persons familiar with the related technology. The feed press 42 may be any conventional mechanism for forming a closure form the decorated metal disks, as will be understood by persons familiar with closure forming technology.

Color sensor 28' and separator 30' are similar to color sensor 28 and separator 30 respectively described above. Color sensor 28' is calibrated to a predetermined color that is part of the trade dress or desired decoration of the closure. For example, the printing process may provide a desired color at the center of the decorated metal disk, which will correspond the button 134 of the closure after forming. In such circumstances, the color sensor 28' may be configured to view and sense the portion of the decorated metal disk having the desired color, and the color sensor may be calibrated (as described above) according to the predetermined desired color at the appropriate and predetermined location on the decorated metal disk.

The color sensor 28' could sense and detect the predetermined color, which would indicate that the decorated metal disk has the appropriate color in the specified location. The color sensor 28' may then send a signal to a controller (not shown) that indicates that the portion of the decorated metal disk that is sensed by the color sensor has the appropriate color or is within an appropriate color range. Upon sensing a decorated metal disk that lacks the predetermined color, the separator 30' may be activated to remove the defective color decorated metal disk from the conveyor. Thus, the color sensor 28' may be combined with another sensor, including for example a proximity, light beam, or machine vision sensor, that senses the presence of the disk. The controller may send a signal to activate the separator 30' upon the color sensor 28' not sensing the appropriate color of the disk while the other sensor indicates that a disk is present. The system may for example be employed to indicate the lack of printing on a decorated metal disk, or the printing of an incorrect color on a particular location on the disk (according to the predetermined color).

The specification employs a particular embodiment to illustrate aspects of the present invention. Other aspects and features of the invention will be apparent to persons familiar with the sensing technology and closure lining processes and technology, and/or the printing and inspection process and technology, in light of the disclosure herein. Further, the present invention is not limited to the particular embodiments or features described herein. Rather, the present invention encompasses other embodiments that will be understood by persons familiar with the technology described herein, including for example any location of the sensor to sense or detect the color status of the closures and/or decorated metal disks, the system described herein sensing or detecting linings of closures or decorated metal disks other than those corresponding to the metal container disclosure described herein, a system employing a lining compound that does not require thermal curing (including those cured by air, visible light, ultraviolet radiation and the like, as well as a lining that requires no curing) thereby modifying or eliminating the oven, a system employing pre-formed gaskets in which a compound station may be eliminated, and similar embodiments within the scope of the appended claims.

We claim:

1. A system for detecting a lining compound of a container closure that includes a panel having a lining compound on at least a portion thereof, said system comprising:

a conveyor for moving said plural closures longitudinally therealong, said conveyor having a conveying surface that supports an outside surface of said closures;

a color sensor that senses said panel of each one of said closures on said conveyor for a predetermined color, said color sensor being capable of identifying a sufficient color status that corresponds to a sufficient lining compound and a deficient color status that corresponds to an insufficient lining compound; and a separator capable of removing from said conveyor closures having a deficient color status, a compound machine that sprays the lining compound on said panel, said lining compound forming a cured lining after curing, said color sensor disposed between said compound machine and an oven;

whereby said system automatically identifies and removes said closures that have said deficient color from the conveyor.

2. The system of claim 1 wherein said lining compound comprises a plastisol.

3. The system of claim 2 wherein said closures are heated in said oven to cure said plastisol.

4. The system of claim 3 wherein said oven heats said closures to approximately 380 degrees to 400 degrees Fahrenheit.

5. The system of claim 1 wherein said color sensor senses a predetermined wavelength of light to identify the sufficient color status.

6. The system of claim 1 wherein the separator comprises a compressed air jet that blows said closures having the deficient color status from said conveyor.

7. The system of claim 1 wherein said color sensor is directed to said conveyor surface.

8. The system of claim 1 wherein said color sensor is capable of sensing a predetermined wavelength of light to identify the sufficient color status.

9. The system of claim 1 wherein the closure is unitary such that the panel is unitarily formed with a skirt.

* * * * *